US005935749A

United States Patent [19]

Kawata et al.

[11] Patent Number: 5,935,749

[45] Date of Patent: Aug. 10, 1999

[54] PHOTOCONDUCTOR FOR INTERNAL IRRADIATION ELECTROPHOTOGRAPHY

[75] Inventors: Noriaki Kawata; Kei Yamaguchi; Yutaka Ikeda, all of Kawasaki, Japan

[73] Assignee: Fuji Electric Co., Ltd., Kawasaki, Japan

[21] Appl. No.: 08/917,221

[22] Filed: Aug. 25, 1997

[30] Foreign Application Priority Data

Aug. 26, 1996 [JP] Japan ..... 8-223441
Jan. 31, 1997 [JP] Japan ..... 9-019077

[51] Int. Cl.[6] ..... G03G 5/14

[52] U.S. Cl. ..... 430/66; 430/132

[58] Field of Search ..... 430/31, 66, 67, 430/132

[56] References Cited

U.S. PATENT DOCUMENTS 3,335,003 8/1967 Snelling ..... 430/31
5,320,927 6/1994 Fender et al. ..... 430/128

FOREIGN PATENT DOCUMENTS 7-319195 12/1995 Japan .

*Primary Examiner*—John Goodrow
*Attorney, Agent, or Firm*—Venable; Robert J. Frank; Ashley J. Wells

[57] ABSTRACT

A photoconductor for internal irradiation electrophotography includes a substrate which is hollow, cylindrical, and transparent, and which is composed of a synthetic resin; an electroconductive layer which is provided on an outer surface of the substrate and which has a surface resistance of no higher than $2\times10^6$ Ω/square; a photosensitive layer which is composed of organic material, which is provided on the electroconductive layer, and which is dip coated from a liquid including an organic solvent; and a protective layer which is provided on an inner surface of the substrate, wherein the protective layer and the electroconductive layer are resistant to the organic solvent of the liquid for dip coating.

12 Claims, 4 Drawing Sheets

PHOTOCONDUCTOR FOR INTERNAL IRRADIATION ELECTROPHOTOGRAPHY

BACKGROUND OF THE INVENTION

1. Field of the Invention

The present invention relates to an image recording substrate for use in electrophotography and more particularly to an image recording substrate used as a photosensitive drum for internal irradiation electrophotographic apparatus such as copiers, laser printers and the like.

2. Description of Related Art

Hitherto, many photoconductors used in recording apparatuses such as copiers, laser printers and the like include an aluminum substrate as a photosensitive drum or photoconductor, and generally such photoconductors are exposed from above the front surface of the photosensitive layer provided on the substrate in an exposure process.

In this exposure method, apparatuses used in various steps such as charging, exposure, development, image transfer, fixing, static elimination, and cleaning have to be arranged around the photosensitive drum of an electrophotographic apparatus. This poses a limitation on trials for down sizing of recording apparatuses and could cause developers to dissipate from the developing apparatus, thus contaminating the optical system included in the exposing apparatus to adversely affect the quality of printing.

A conventional approach for solving these problems was to provide an internal irradiation type electrophotographic apparatus which includes a photosensitive drum comprising a transparent substrate having coated thereon an electroconductive layer and a photosensitive layer and a light source for exposure arranged inside the drum as a photoconductor so that the apparatus can be rendered down sized and the contamination of the optical system by dissipation of the developer can be prevented.

In the manufacture of photoconductive drums used in such an internal irradiation type electrophotographic apparatuses, there has been used a technique in which indium tin oxide (hereafter, abbreviated as "ITO") or the like is deposited by sputtering or vacuum deposition in order to form a transparent electroconductive layer on a transparent substrate such as inorganic glass or the like. Japanese Patent Application Laying-open No. 319195/1995 (Fujitsu) discloses a photosensitive drum comprising a cylindrical glass substrate having superimposed thereon a doped polyaniline.

The-above described conventional approaches have problems that cylindrical inorganic glass substrates are expensive, poor in dimensional precision, and fragile, and film formation of the transparent electroconductive layer by sputtering or vacuum deposition is poor in productivity and the step of forming a doped polyaniline layer is costly.

The features required for substrates for use in internal irradiation type electrophotographic apparatuses include low cost of materials to be used, high dimensional precision, sufficient mechanical strength for photosensitive drums, chemical stability not to deteriorate its quality as a photosensitive drum even in an uncontrolled open air, enough transparency to allow irradiation to transmit without refraction upon exposure, high adhesion with the transparent electroconductive layer on the substrate, solvent resistance and heat resistance required when forming a photosensitive layer by dip coating, which is highly productive, and the like.

On the other hand, the features that transparent electroconductive layers must have include low cost, transparency upon exposure, i.e., allowing irradiation to pass through without refraction, appropriate surface resistance within the ranges that allow use as a photosensitive drum, and the like. There has been a demand for the development of an improved photoconductor for electrophotography in these and some other respects.

SUMMARY OF THE INVENTION

Therefore, it is an object of the present invention to provide an internal irradiation type photoconductor for electrophotography provided with a transparent substrate which is low in cost, has a sufficient mechanical strength, and is excellent in dimensional precision.

Another object of the present invention is to provide a photoconductor for electrophotography having an improved surface property, i.e., surface roughness.

With view to solving the above-described problems, various low cost synthetic resins have been tested for their feasibility as a transparent substrate for photoconductor for electrophotography. After intensive investigation, it has now been found that use of high precision extrusion molding can give rise to a hollow cylindrical substrate which is transparent and has high dimensional precision. The present invention is based on this discovery.

Therefore, in one aspect of the present invention, there is provided a photoconductor for internal irradiation electrophotography, comprising:

a hollow cylindrical transparent substrate comprising a synthetic resin;

an electroconductive layer provided on an outer surface of the substrate, the electroconductive layer having a surface resistance of no higher than $2\times10^6$ Ω/square;

a photosensitive layer lying over the electroconductive layer; and a protective layer provided on an inner surface of the substrate having a resistance to a solvent used when the photosensitive layer is formed.

(2) The photoconductor for internal irradiation electrophotography as described in (1) above, wherein the transparent synthetic resin substrate may comprise at least one resin selected from the group consisting of polyphenylene sulfide, polycarbonate, saturated polyester, polymethylpentene, polyacrylonitrile, polynorbornene and noncrystalline polyolefin.

(3) The photoconductor for internal irradiation electrophotography as described in (1) or (2) above, wherein the transparent synthetic resin substrate may be one extruded with a die having a fluororesin-coated surface.

(4) The photoconductor for internal irradiation electrophotography as described in (1), (2), or (3) above, wherein the electroconductive layer may be a transparent electroconductive layer comprising a material selected from the group consisting of indium tin oxide and tin oxide.

(5) The photoconductor for internal irradiation electrophotography as described in any one of (1) to (4), wherein the protective layer may comprise a material selected from the group consisting of indium tin oxide, tin oxide, and silicone resin.

According to the present invention, a substrate material, which comprises a synthetic resin, can be molded continually to prepare a transparent substrate for use in internal irradiation electrophotographic apparatuses, and the transparent electroconductive layer can be formed by dip coating a substrate with a transparent electroconductive coating solution. This makes it possible to provide photosensitive drums for use in internal irradiation electrophotographic apparatuses having excellent mechanical strength, electric properties, and printability at low costs.

In addition, appropriate selection of synthetic resins for substrate material enables one to prepare photosensitive drums having excellent resistance to solvents used and resistance to heat during the fabrication of photosensitive drums and having excellent surface properties so that there can be provided less expensive substrates as a transparent support substrate for a photosensitive drum for use in internal irradiation electrophotographic apparatus.

A die having a fluororesin-coated surface solves the problem that the synthetic resin material suffer from scratches on its inner and outer surfaces running in the longitudinal direction due to contact with the die during extrusion processing because of reduced contact resistance, thus allowing the extruded substrate to have excellent surface properties.

According to the present invention, use is made of cylindrical transparent substrates prepared by extrusion from transparent synthetic resins, preferably PPS resins, PC resins, PET resins, TPX resins, PAN resins, polynorbornene resins and noncrystalline polyolefin resins as a photoconductor for use in internal irradiation electrophotographic apparatuses, so that the resulting substrates are featured by low cost, sufficient strength, and high dimensional precision such as surface roughness and roundness as compared with conventional cylindrical inorganic glass substrate.

Also, use is made of a coating liquid containing ITO or $SnO_2$ in the formation of a transparent electroconductive layer on the above-described transparent cylindrical synthetic resin substrate makes it possible to carry out the process by continuously dip coating of such a substrate, thus making possible mass production on an industrial scale.

Further, coating of the transparent electroconductive material so that the transparent electroconductive layer can have a surface resistance of no higher than $2\times10^6$ Ω/square results in that the substrate has excellent electrical properties as a photosensitive drum.

DESCRIPTION OF PREFERRED EMBODIMENTS

Hereinafter, the present invention will be described in detail with reference to the attached drawings.

Figure 1:
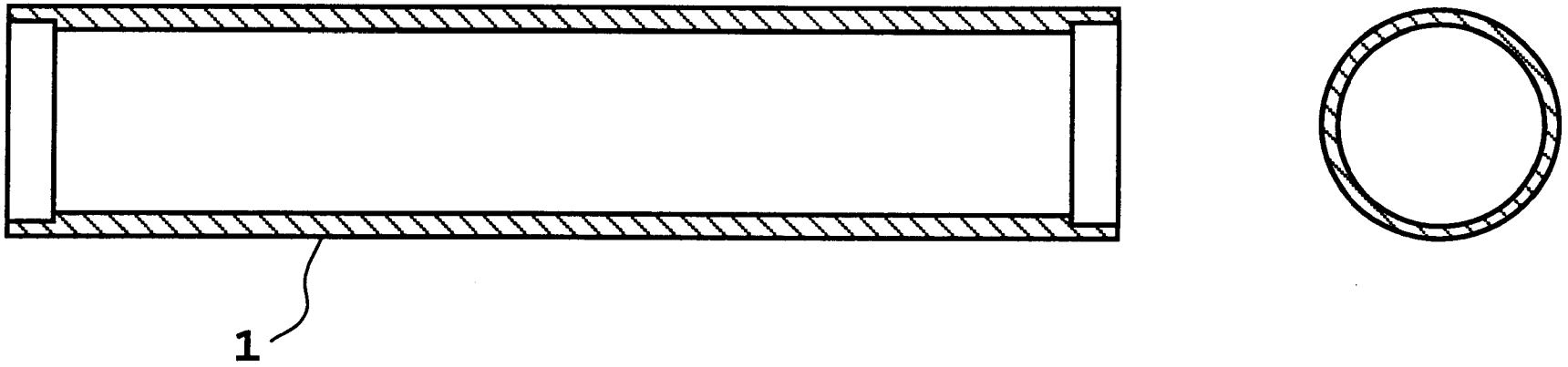
FIG. 1 is a cross-sectional view showing a substrate for use in a photosensitive drum according to an embodiment of the present invention.
Figure 2:
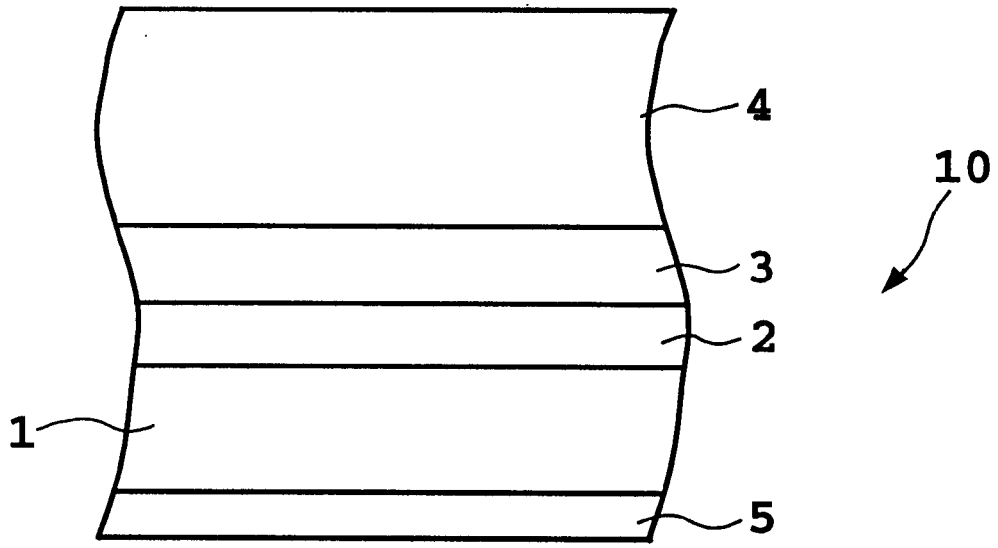
FIG. 2 is a cross-sectional view showing a multilayer structure for use in a photosensitive drum according to an embodiment of the present invention.
Figure 3:
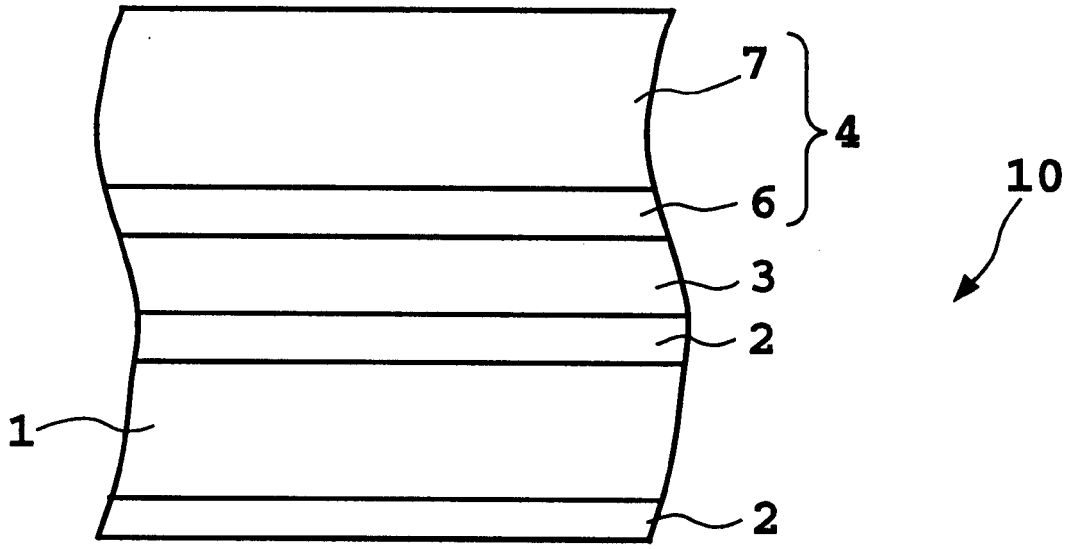
FIG. 3 is a cross-sectional view showing a multilayer structure for use in a photosensitive drum according to an embodiment of the present invention.

FIG. 1 shows a hollow cylindrical substrate for image recording drum, or a photosensitive drum, for use in an electrophotographic apparatus according to the present invention. Reference numeral 1 designates a photosensitive drum. FIG. 2 is a cross-sectional view showing the multilayer structure of a photosensitive drum 10. The multilayer structure comprises the substrate 1 for the photoconductive drum 10, made of a transparent synthetic resin, a transparent electroconductive layer 2 provided on the outer surface of the substrate 1, an undercoating layer 3 superimposed on the transparent electroconductive layer 2, a photosensitive layer 4 provided on the undercoating layer 3, and a protective layer 5 provided on the inner surface of the cylindrical substrate 1 or tube.

In the present invention, the transparent support substrate 1 for use in internal irradiation electrophotographic apparatus can be a cylindrical molded article or tube which comprises a transparent, less expensive synthetic resin. Examples of the material constituting the transparent substrate or tube include polyphenylene sulfide resins (hereafter, abbreviated as "PPS resins"), polycarbonate resins (hereafter, abbreviated as "PC resins"), saturated polyester resins (hereafter, abbreviated as "PET resins"), polymethylpentene resins (hereafter, abbreviated as "TPX resins"), polyacrylonitrile resins (hereafter, abbreviated as "PAN resins"), polynorbornene resins, and noncrystalline polyolefin resins. These resins may be used singly or two or more of them may be used in combination.

Preferred examples of the resins which are resistant to organic solvents used during the preparation of photosensitive drum, such as, for example, isophorone, dichloromethane, and tetrahydrofuran include TPX resins, PAN resins, polynorbornene resins and noncrystalline polyolefin resins. PPS resins are preferred since they can be prevented from becoming opaque by quenching the extruded substrate upon extrusion molding and can be rendered transparent instead of the fact that they are originally crystalline and colored. Further, among the transparent substrates which can be used in the present invention, those which are prepared by extrusion molding with a die having a fluororesin coated surface in order to reduce the contact resistance of the molten material therewith since the molded article or tube have excellent surface properties.

In view of printability, the transparent synthetic resin substrate thus molded preferably has a transparency in terms of total light transmittance of no lower than 80%.

Although the transparent synthetic resin substrate 1 has a mechanical strength high enough to be useful as a photosensitive drum, it is possible that the substrate 1 may be vulnerable to change in configuration due to swelling or dissolution in certain solvents. Hence, it is necessary to select proper solvents in the step of coating on a surface of a substrate a solution of a material for an electroconductive layer in a solvent or in the step of forming a clear coat film on the opposite surface of the substrate, so that no change in configuration can occur. As for the solvents which are used in the formation of a photosensitive layer 4, which occurs subsequently, the electroconductive layer or clear coat film serves as a protective layer to these solvents and, hence, there can be selected those solvents that are optimally suited for forming the photosensitive layer regardless of the resistance of the substrate thereto.

Further, in the present invention, a transparent electroconductive coating liquid containing ITO or $SnO_2$ can be deposited on the transparent substrate 1 by a coating method which is advantageous from the view point of cost to form an electroconductive layer 2 in order to obtain a surface resistance which is necessary for the multilayer structure to be useful as a photoconductor for electrophotography, e.g., a surface resistance of no higher than $2\times10^6$ Ω/square, and to take the advantage of the transparency of the support substrate 1 for use in a photosensitive drum for internal irradiation electrophotographic apparatus. In this case, solvents which do not cause loss of transparency or change in configuration of the transparent synthetic resin substrate as described above are used for preparing a transparent electroconductive coating liquid containing ITO or $SnO_2$ to form the electroconductive layer 2. The resulting coating liquid can be coated by a known method such as, for example, dip coating, spray coating, wire bar coating, seal coating or the like. Controlling film thickness will give rise to an electroconductive layer with a surface resistance of no higher than $2\times10^6$ Ω/square. In the case of seal coating method, a surface resistance of lower than $10^2$ Ω/square results in a decrease in transparency and is undesirable.

The electroconductive layer formed has a thickness of generally 0.5 to 5 μm, preferably 1 to 3 μm. In the case of dip coating method, a film thickness of thicker than 5 μm results in a decreased transparency while a film thickness of smaller than 0.5 μm will lead to a surface resistance of higher than $2\times10^6$ Ω/square.

The undercoating layer 3 may comprise alcohol-soluble polyamides, solvent-soluble aromatic polyamides, and polyurethanes and melamine resins as thermosetting resins, and the like, either singly or in combination. The alcohol-soluble polyamides are preferably copolymers such as nylon-6, nylon-8, nylon-12, nylon-66, nylon-610, and nylon-612, N-alkyl- or N-alkoxyalkyl-modified nylons. Specific examples of these include Amilan CM8000 (Toray, 6/66/610/12 copolymer nylon), Elvamide 9061 (DuPont Japan, 6/66/612 copolymer nylon) , Diamide T-170 (Daicel-Hürtz, nylon-12 based copolymer nylon), etc.

Further, the undercoating layer 3 may contain inorganic powder such as $TiO_2$, alumina, calcium carbonate, silica, and the like singly or in combination. The inorganic powder may be present in amounts of 20 to 80% by weight, preferably 30 to 60% by weight, based on the total weight of the composition. The undercoating layer 3 has a film thickness of 0.05 to 20 μm, preferably 0.05 to 10 μm.

The photosensitive layer 4 may be of a single layer type in which particles of a charge generation substance and particles of a charge generation substance are dispersed or dissolved in a binder resin or of a function-separated type which has two layers, i.e., a charge generation layer 6 and a charge transport layer 7. The order in which the charge generation layer 6 and the charge transport layer 7 are superimposed is not limited. The former may be above the latter vice versa.

The charge generation layer 6 can be formed by coating or vacuum depositing a material comprising a binder resin having dispersed therein particles of a charge generation substance and generate charges when it receives light. It is important that the charge generation layer 6 has a high charge generation efficiency and at the same time injectability of the generated charges into the charge transport layer, and it is desirable that the charge generation layer 6 is less dependent on electric field and charges can be injected into the charge transport layer 7 at high rates in a low electric field.

As the charge generation substance, there can be cited, for example, phthalocyanine compounds such as metal-free phthalocyanine and titanyl phthalocyanine, pigments or dyes such as azo compounds, quinone compounds, indigo compounds, cyanine compounds, squarylium compounds, azulenium compounds, and pyrilium compounds, selenium or selenium compounds. These charge generation substance may be selected properly in accordance with the wavelength ranges of exposure light source used for image formation. The film thickness of the charge generation layer may be generally no larger than 5 μm, preferably 0.1 to 1 μm since it is only necessary for the charge generation layer to exhibit a charge generation function and the thickness of the charge generation layer depends on the optical absorbance of the charge generation substance. The charge generation layer 6 may comprise mainly a charge generation substance and additionally a charge transport substance. The binder resin may be one selected from polycarbonates, polyesters, polyamides, polyurethanes, polyvinyl chlorides, phenoxy resins, polyvinyl butyrals, diallyl phthalate resins, homo- and copolymers of methacrylic acid esters, singly or in combination.

The charge transport layer 7, which is a coating layer that contains a binder resin and also contains dispersed in the binder resin various hydrazone compounds, styryl compounds, amine compounds and derivatives thereof singly or in combination as a charge transport substance, holds charges in the photosensitive layer as an insulation layer in the dark while upon receipt of light, exhibits the function of transporting the charges injected from the charge generation layer. The charge transport layer has a thickness of preferably 10 to 40 μm. As the binder resin can be used polycarbonates, polyesters, polystyrenes, homo- and copolymers of methacrylic acid esters, and the like. In order to prevent the deterioration of the charge transport layer due to ozone attributable to corona discharge when the resulting photoconductor is in repeated use, the charge transport layer 7 may contain antioxidants such as amine compounds, phenol compounds, phosphorous acid ester compounds, phosphorus compounds and the like.

It is preferred that the photoconductor be irradiated with UV rays in order to strengthen bonding between the layers.

In the photoconductor having the structure having a transparent synthetic resin substrate and a photosensitive layer containing an organic photoconductive substance as described above, surface charges are grounded through the substrate during each of the processes of exposure, development, transfer of toner to a recording paper, and erasing potential and, hence, formation of static latent images or erasing potential cannot be performed smoothly if the substrate has a high electrical resistance. For this reason, it is necessary for the transparent electroconductive layer 2 superimposed on the synthetic resin substrate 1 to have a surface resistance of $2\times10^6$ Ω/square.

In this regard, as the material for the transparent synthetic resin substrate are most suited PPS resins, PC resins, PET resins, TPX resins, PAN resins, polynorbornene resins, and noncrystalline polyolefin resins that undergo less dimensional changes with lapse of time, have excellent resistance to solvents and transparency as well as are less expensive. Further, it is most suitable to use electroconductive coating composition containing ITO or $SnO_2$ which can be dip coated.

As for the protective layer 5, silicone varnish film may be formed on the inner surface of the substrate or hollow cylinder since the inner surface of the substrate does not have to be electroconductive. From the viewpoint of productivity, it is preferred to use as the protective layer 5 the same material as the electroconductive layer 2.

EMBODIMENTS

Hereafter, the present invention will be described in detail by examples and comparative examples which are only exemplary and by no means limit the scope of the present invention. In the examples and comparative examples which follow, all parts are by weight and the die used in extrusion molding the resins had a fluororesin coated surface.

EXAMPLE 1

PPS resin (Toray, PPSM 2588) was extruded at a cylinder temperature of 360° C. and molded into a cylindrical form of 60 mm in outer diameter and 2 mm thick under the conditions of quenching by dipping in water. This molded article was cut to a length of 350 mm to obtain a cylindrical transparent substrate or tube. Then, the dirt on the surface was degreased and removed prior to coating the tube in a transparent electroconductive coating liquid containing isophorone ($C_9H_{14}O$) as a solvent and ITO based material (Shokubai Kasei Kogyo, ELCOMP-1202) so that the coating liquid was coated on both inner and outer surfaces of the tube to form a transparent electroconductive layer of 3 $\mu$m thick.

Then, the thus treated tube was dip coated with a coating liquid containing 10 parts of alcohol soluble polyamide (Toray, CM8000) in a mixed solvent of 10 parts of methanol and 40 parts of butanol to form a 0.1 $\mu$m thick undercoating layer.

Further, a mixture of 1 part of X type metal-free phthalocyanine (Dainippon Ink and Chemicals Industry, FASTGEN BLUE 8120) as a charge generation substance, 1 part of polyvinyl butyral resin (Sekisui Chemical Industry, S-LEK BM-1) as a binder resin, and 98 parts of dichloromethane was dispersed on a sand grinder for 1 hour. The resulting dispersion was dip coated on the undercoating layer described above and dried at 80° C. for 30 minutes to form a 0.5 $\mu$m thick charge generation layer.

Subsequently, a solution of 10 parts of a charge transport material represented by the structural formula (I), 10 parts of a copolymer polycarbonate consisting of bisphenol A and biphenyl (Idemitsu Kosan, TOUGHZET) and 80 parts of dichloromethane was dip coated on the charge generation layer, and dried at 100° C. for 1 hour to form a 20 $\mu$m thick charge transport layer, thus fabricating a photoconductor.

(I)

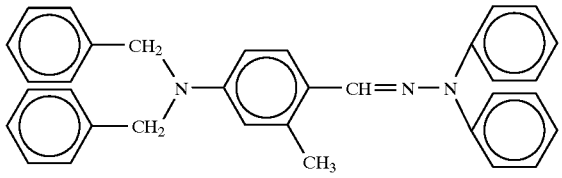

EXAMPLE 2

A photoconductor was fabricated in the same manner as in Example 1 except that PC resin (Teijin, Panlite L-1225) was extrusion molded to form a cylindrical transparent substrate.

EXAMPLE 3

A photoconductor was fabricated in the same manner as in Example 1 except that PET resin (Unitika, PETSA 1206) was extrusion molded to form a cylindrical transparent substrate.

EXAMPLE 4

A photoconductor was fabricated in the same manner as in Example 1 except that TPX resin (Mitsui Petro Chemical Industry, TPX RT18) was extrusion molded to form a cylindrical transparent substrate and $SnO_2$ containing transparent electroconductive coating liquid (Shokubai Kasei Kogyo, ELCOM P-3530) was used instead of the ITO containing transparent electroconductive coating liquid.

EXAMPLE 5

A photoconductor was fabricated in the same manner as in Example 1 except that PAN resin (Mitsui Toatsu, Parex#4205) was extrusion molded at a cylinder temperature of 200 to 220° C. to form a cylindrical transparent substrate.

Here, the extrusion molding was performed with a die having a fluororesin coated surface. The fluororesin coated surface was obtained by coating a dispersion of polytetrafluoroethylene (PTFE) on the surface of the die, drying, and then sintering the coated layer at a temperature of 350 to 400° C. for about 1 hour. For comparison, a photoconductor tube was fabricated by extrusion with a surface-untreated die and precision s in terms of surface roughness (Rmax) and roundness were compared between the both types of as-extruded tubes. Results are shown below.

| Precision of as-extruded tube | With PTFE-treated die | With PTFE-untreated die |
|---|---|---|
| Surface roughness (Rmax) | 0.2 to 1.0 $\mu$m | 1 to 2.5 $\mu$m |
| Roundness | 30 to 50 $\mu$m | 100 to 140 $\mu$m |

EXAMPLE 6

A photoconductor was fabricated in the same manner as in Example 1 except that polynorbornene resin (Japan Synthetic Resin, ARTONG) was extrusion molded at a cylinder temperature of 260 to 280° C. to form a cylindrical transparent substrate.

EXAMPLE 7

A photoconductor was fabricated in the same manner as in Example 1 except that noncrystalline polyolefin (Nippon Zeon, ZEONEX 250) was extrusion molded at a cylinder temperature of 250 to 270° C. to form a cylindrical transparent substrate.

COMPARATIVE EXAMPLE 1

A photoconductor was fabricated in the same manner as in Example 1 except that a cylindrical inorganic glass substrate was degreased and removed of the dirt from its surface and then an ITO film was formed on the thus-cleaned surface by DC magnetron sputtering, followed by coating an organic photoconductive substance.

COMPARATIVE EXAMPLE 2

A photoconductor was fabricated in the same manner as in Example 1 except that the cylindrical transparent substrate was degreased and removed of the dirt from its surface and then an ITO containing coating liquid (Shokubai Kagaku Kogyo, ELCOM P-1202) was seal coated on the thus-cleaned surface such that the resulting surface has a surface resistance of $10^7$ Ω/square.

COMPARATIVE EXAMPLE 3

A photoconductor was fabricated in the same manner as in Example 1 except that PPS resin (Toray, PPS M2588) was extrusion molded at a cylinder temperature of 360° C. without quenching to form a cylindrical transparent substrate.

COMPARATIVE EXAMPLE 4

A photoconductor was fabricated in the same manner as in Comparative Example 2 except that a cylindrical transparent substrate obtained from the same material and by the same method as in Example 5 was used.

The substrates and photoconductors fabricated in Examples 1 to 7 and Comparative Examples 1 to 4 were measured for total light transmittance before coating the organic photoconductive substance, surface roughness, roundness, dimensional precision, dimensional changes with lapse of time with heating at 100° C. or 80° C., and the results obtained are shown in Tables 3 and 4 below.

Figure 4:
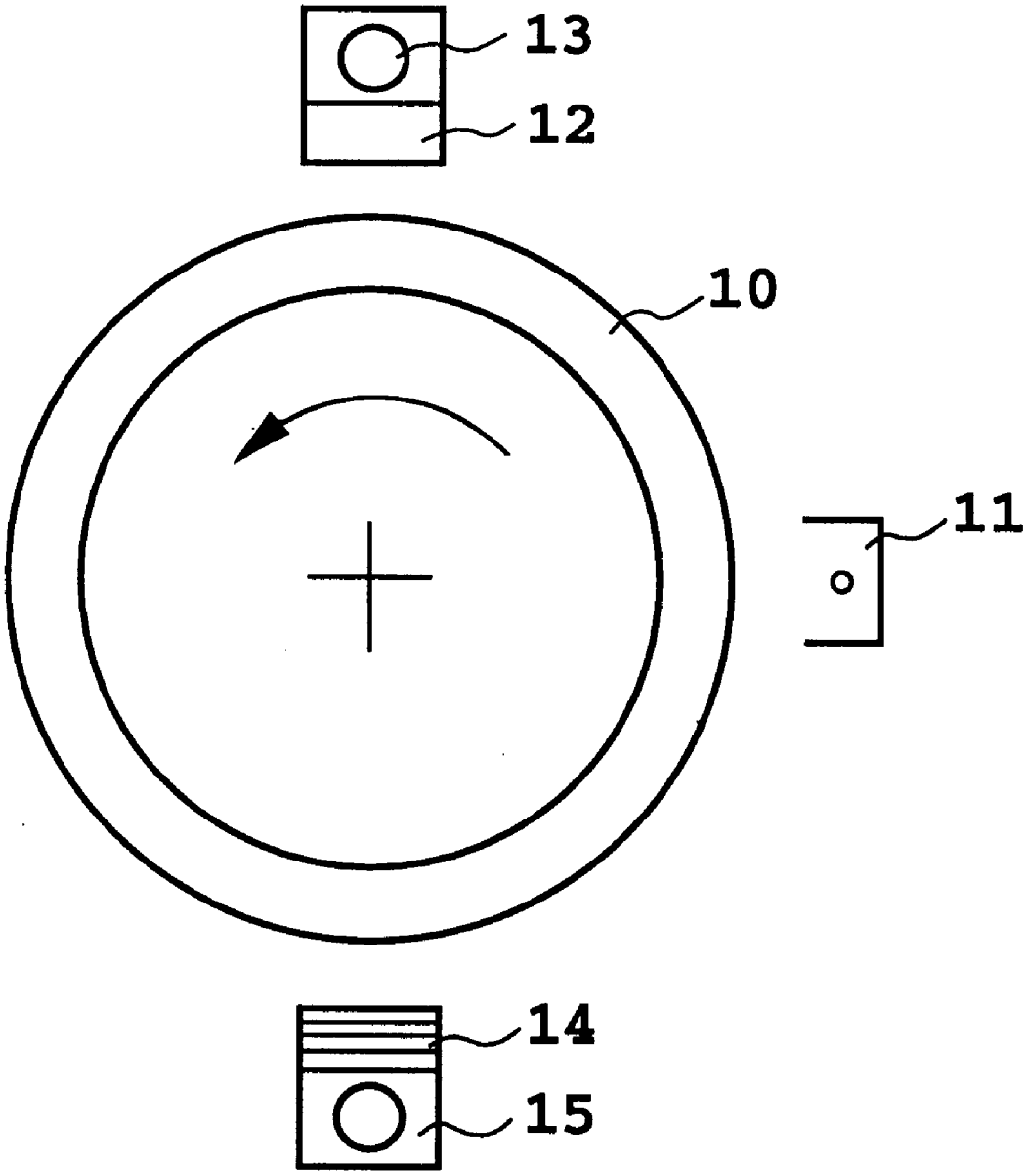
FIG. 4 is a schematic diagram illustrating the principle of measurement on which a testing machine for measuring electrical characteristics used in examples of the present invention is based.

Principle of measurement using the testing machine shown in FIG. 4 is as follows. A photoconductive drum 10 is rotated in the direction indicated by the arrow in FIG. 4 at a peripheral speed of 60 mm/second during which charge is give by a Corotron charger 11 to a voltage of −600 V and the potential under the condition of non-exposure of a probe 12 having an exposure light source 13 is defined as a dark potential $V_0$. Then, the rotation is stopped and the drum 10 is left to stand in the dark for 5 seconds, followed by measuring a potential retention $V_{k5}$ (%). Subsequently, the drum 10 is exposed to light at a wavelength of 660 nm at a radiation illuminance of 2 $\mu$w/cm$^2$, and a potential after 0.2 seconds is defined as a bright potential Vi, and a potential after 15 seconds is defined as a residual potential Vr.

Figure 5:
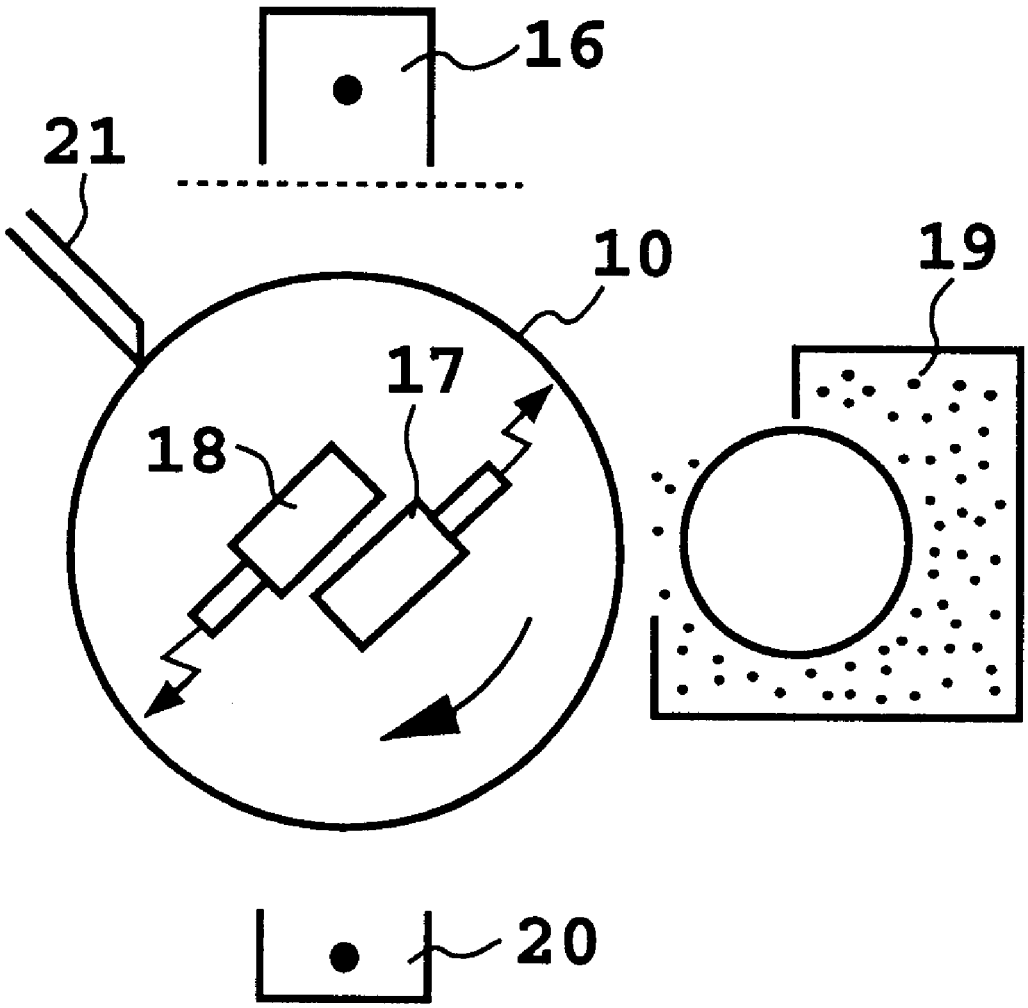
FIG. 5 is a diagram illustrating the arrangement of process apparatuses in relation to a testing machine used for printability tests in examples of the present invention.

Further, the testing machine shown in FIG. 5 includes a photoconductor 10, an electrostatic charger 16, an exposure light source 17, an eraser lamp 18, a developing apparatus 19, a transfer apparatus 20, and a cleaning blade 20. The photoconductor or drum 10 is rotated at a peripheral speed of 60 mm/second during which operation the drum 10 is charged by the electrostatic charger 16 to a potential of −600 V, with exposing with light at a radiation illuminance of 2 $\mu$w/cm$^2$ by the exposure light source 17. The resulting latent image is developed with a toner from the developing apparatus 19 and then transferred to a recording paper by the transferring machine. After the transfer process is over, the eraser lamp 18 erases the charge potential on the drum 10 and the remaining toner is removed from the surface of the drum by the cleaning blade 21. This cycle is repeated until a desired number of paper sheet is reached.

TABLE 1

| | Ex. 1 | Ex. 2 | Ex. 3 | Ex. 4 | C.Ex. 1 | C.Ex. 2 | C.Ex. 3 |
|---|---|---|---|---|---|---|---|
| Resin | PPS | PC | PET | TPX | Glass | PPS | PPS |
| Transparent electroconductive | ITO | ITO | ITO | SnO | ITO | ITO | ITO |
| Moldability | Good | Good | Good | Good | — | Good | Good |
| Total light transmittance | 85 | 89 | 88 | 92 | 95 | 85 | 17 |
| Surface resistance (Ω/square) | $2 \times 10^6$ | $3 \times 10^4$ | $3 \times 10^4$ | $9 \times 10^3$ | $9 \times 10^6$ | $1 \times 10^7$ | $2 \times 10^6$ |
| Surface roughness Rmax ($\mu$m) | 0.9 | 0.8 | 1.5 | 1.8 | 1.2 | 0.9 | 0.9 |
| Roundness ($\mu$m) | 40 | 40 | 50 | 50 | 80 | 40 | 60 |
| Dimensional precision (ϕ 30 ± mm) | 0.05 | 0.03 | 0.05 | 0.07 | 0.15 | 0.05 | 0.05 |
| Dimensional change 100° C./48 hrs (%) | 0 | −0.2 | −0.1 | −0.2 | 0 | 0 | 0 |

TABLE 2

| | Ex. 5 | Ex. 6 | Ex. 7 | C.Ex. 1 |
|---|---|---|---|---|
| Resin | PAN | Polynor[1)] | Nonol[2)] | PAN |
| Transparent electroconductive | ITO | ITO | ITO | ITO |
| Moldability | Good | Good | Good | Good |
| Total light transmittance | 85 | 98 | 98 | 85 |
| Surface resistance (Ω/square) | $2 \times 10^6$ | $3 \times 10^4$ | $3 \times 10^4$ | $1 \times 10^7$ |
| Surface roughness Rmax ($\mu$m) | 0.9 | 0.8 | 1.5 | 0.9 |
| Roundness ($\mu$m) | 50 | 40 | 50 | 50 |
| Dimensional precision (ϕ 30 ± mm) | 0.05 | 0.03 | 0.05 | 0.05 |
| Dimensional change 100° C./48 hrs (%) | −0.2 | 0 | −0.1 | −0.2 |

Notes:
1)"Polynor" stands for polynorbornene.
2)"Nonol" stands for noncrystalline polyolefin.

TABLE 3

| | Ex. 1 | Ex. 2 | Ex. 3 | Ex. 4 | C.Ex. 1 | C.Ex. 2 | C.Ex. 3 |
|---|---|---|---|---|---|---|---|
| Vo (−V) | 655 | 650 | 648 | 650 | 652 | 655 | 650 |
| Vk5 (%) | 92 | 90 | 93 | 92 | 91 | 95 | 92 |
| Vi (−V) | 63 | 66 | 65 | 63 | 67 | 222 | 67 |
| Vr (−V) | 21 | 22 | 20 | 18 | 23 | 91 | 22 |
| Printability | Good | Good | Good | Good | Good | Failure | Impossible |

TABLE 4

| | Ex. 5 | Ex. 6 | Ex. 7 | C.Ex. 4 |
|---|---|---|---|---|
| Vo (−V) | 655 | 650 | 648 | 655 |
| Vk5 (%) | 92 | 90 | 93 | 95 |
| Vi (−V) | 63 | 66 | 65 | 222 |
| Vr (−V) | 21 | 22 | 20 | 91 |
| Printability | Good | Good | Good | Failure |

Next, the resistance to solvents of each transparent substrate tube used in the examples was examined. Table 5 below shows the contents of the tests and test method and results obtained.

TABLE 5

| Test | Method | Resin | | | | | | |
|---|---|---|---|---|---|---|---|---|
| | | PPS | PC | PET | TPX | PAN | Polynor[3)] | Nonol[4)] |
| Dissolution[1)] | 3 Minutes' Dipping in DCM | A | C | C | A | A | B | B |
| Dissolution[1)] | 3 Minutes' Dipping in THF | A | C | C | A | A | B | B |
| Whitening[2)] | 3 Minutes' Dipping in DCM | C | — | — | A | A | A | A |
| Whitening[2)] | 3 Minutest Dipping in THF | C | — | — | A | A | A | A |

Notes:
[1)]"A" indicates no dissolution.
"B" indicates a little dissolution.
"C" indicates a considerable dissolution.
[2]"A" indicates no whitening.
"B" indicates a little whitening.
"C" a considerable whitening.
[3)]"Polynor" stands for polynorbornene.
[4)]"Nonol" stands for noncrystalline polyolefin.
Abbreviation:
DCM: dichloromethane
THF: tetrahydrofuran

What is claimed is:

1. A photoconductor for internal irradiation electrophotography, comprising:

a substrate which is hollow, cylindrical, and transparent, and which is comprised of a synthetic resin;

an electroconductive layer which is provided on an outer surface of the substrate and which has a surface resistance of no higher than $2\times10^6$ Ω/square;

a photosensitive layer which is comprised of organic material, which is provided on the electroconductive layer, and which is dip coated from a liquid including an organic solvent; and a protective layer which is provided on an inner surface of the substrate, wherein the protective layer and the electroconductive layer are resistant to the organic solvent of the liquid for dip coating.

2. The photoconductor as claimed in claim 1, wherein the substrate comprises at least one resin selected from the group consisting of polypropylene sulfide, polycarbonate, saturated polyester, polymethylpentene, polyacrylonitrile, polynorbornene and noncrystaline polyolefin.

3. The photoconductor as claimed in claim 2, wherein the substrate is extruded with a die having a fluororesin-coated surface.

4. The photoconductor as claimed in claim 3, wherein the electroconductive layer is transparent and is comprised of a material selected from the group consisting of indium tin oxide and tin oxide.

5. The photoconductor as claimed in claim 4, wherein the protective layer comprises a material selected from the group consisting of indium tin oxide, tin oxide, and silicone resin.

6. The photoconductor as claimed in claim 1, wherein the substrate is extruded with a die having a fluororesin-coated surface.

7. The photoconductor as claimed in claim 6, wherein the electroconductive layer is transparent and is comprised of a material selected from the group consisting of indium tin oxide and tin oxide.

8. The photoconductor as claimed in claim 7, wherein the protective layer comprises a material selected from the group consisting of indium tin oxide, tin oxide, and silicone resin.

9. The photoconductor as claimed in claim 6, wherein the protective layer comprises a material selected from the group consisting of indium tin oxide, tin oxide, and silicone resin.

10. The photoconductor as claimed in claim 1, wherein the electroconductive layer is transparent and is comprised of a material selected from the group consisting of indium tin oxide and tin oxide.

11. The photoconductor as claimed in claim 10, wherein the protective layer comprises a material selected from the group consisting of indium tin oxide, tin oxide, and silicone resin.

12. The photoconductor as claimed in claim 1, wherein the protective layer comprises a material selected from the group consisting of indium tin oxide, tin oxide, and silicone resin.

* * * * *

UNITED STATES PATENT AND TRADEMARK OFFICE

CERTIFICATE OF CORRECTION

PATENT NO. : 5,935,749

DATED : August 10, 1999

INVENTOR(S) : KAWATA et al.

It is certified that error appears in the above-identified patent and that said Letters Patent is hereby corrected as shown below:

In claim 2, line 3, change "polypropylene" to - - polyphenylene - -; and line 5, change "noncrystaline" to - - noncrystalline - -.

Signed and Sealed this

Eleventh Day of April, 2000

*Attest:*

*Attesting Officer*

Q. TODD DICKINSON

*Director of Patents and Trademarks*